United States Patent [19]

Erickson

[11] Patent Number: 4,533,375

[45] Date of Patent: Aug. 6, 1985

[54] CRYOGENIC AIR SEPARATION WITH COLD ARGON RECYCLE

[76] Inventor: Donald C. Erickson, 1704 S. Harbor La., Annapolis, Md. 21401

[21] Appl. No.: 522,516

[22] Filed: Aug. 12, 1983

[51] Int. Cl.[3] ..... F25J 3/02

[52] U.S. Cl. ..... 62/22; 62/30; 62/31; 62/34; 62/42

[58] Field of Search ..... 62/23, 24, 27–34, 62/36, 42, 22

[56] References Cited

U.S. PATENT DOCUMENTS 4,345,925 8/1982 Cheung ..... 62/29

4,384,876 5/1983 Mori et al. ..... 62/18

*Primary Examiner*—Frank Sever

[57] ABSTRACT

The invention provides an efficient means of increasing oxygen purity and recovery and also argon recovery in cryogenic distillative air separation plants. In addition, the invention makes it possible to increase the oxygen delivery pressure from high efficiency triple pressure configurations without using an oxygen vacuum compressor. These advantages are obtained by incorporating an argon recycle compressor within the cold box, which compresses argon from an argon rectifier, causes it to condense against boiling liquid oxygen from the argon stripper, and uses the condensed argon to reflux the argon rectifier. Pressurized high purity oxygen can then be obtained using a LOX pump, plus a split supply pressure configuration in which an elevated pressure rectifier gasifies the LOX.

20 Claims, 5 Drawing Figures

CRYOGENIC AIR SEPARATION WITH COLD ARGON RECYCLE

DESCRIPTION

1. Technical Field

The invention comprises process and apparatus for increasing the efficiency, the oxygen purity, the oxygen pressure, or the argon recovery, singly or in combination, in cryogenic distillative air separation processes.

2. Background Art

In conventional dual pressure air separation processes the oxygen purity is limited by the amount of reboil available to the argon stripping section of the low pressure column, and the argon recovery is limited by the amount of reboil and reflux available to the argon rectification section of the low pressure column. In high efficiency flowsheets these limitations are usually even more severe, since in order to decrease the pressure of the high pressure rectifier, some of the available reboil normally bypasses the argon stripper. The product oxygen pressure is also frequently decreased due to the lower HP rectifier pressure.

U.S. Pat. Nos. 3,277,655, 3,327,489, 4,372,765, and 4,254,629 all disclose low energy flowsheets involving lower than normal HP rectifier pressures, and all result in limited purity oxygen (below about 98%) due to reduced reboil available in the argon stripping section of the LP column. The first three reflect a dual pressure (two column) arrangement, whereas the latter reflects alternatively a triple pressure arrangement with split air supply pressure or a quadruple pressure column arrangement with single supply pressure.

U.S. Pat. No. 2,699,046 to Etienne reflects numerous triple pressure and one quadruple pressure column arrangements. Several of those arrangements also accomplish lower energy requirement at the expense of lower oxygen purity. One, FIG. 6, does not decrease separation energy but increases the purity of the nitrogen product.

U.S. Pat. No. 3,688,513 partly avoids the oxygen purity limitation of low energy triple pressure column flowsheets by incorporating an argon stripper at the bottom of the medium pressure column in addition to the one at the bottom of the LP column. The argon stripping duty is divided between the two strippers, and thus much of the reboil diverted from the LP column to the MP column is still effective in stripping argon. This configuration also incorporates liquid recycle from the LP column overhead back to the MP column, in order to remove argon from the LP column.

This configuration has the disadvantages of requiring two separate argon strippers; not recovering argon; having MP column bottom product hotter than desirable (which requires higher HP column pressure) due to need to eliminate nitrogen from the LP column feed and to the extra pressure drop in the MP argon stripper; and generating oxygen at lower than usual pressure.

U.S. application Ser. No. 501,264 filed 6/6/83 by Donald C. Erickson, which is incorporated by reference, overcomes several of the above disadvantages. A triple pressure configuration is disclosed which only requires an argon stripper at the bottom of the LP column, which allows some nitrogen content in the liquid bottom product of the MP column; which allows argon recovery; and which allows both lower energy (lower high pressure rectifier and supply air pressures) and higher $O_2$ purity. This is done by incorporating latent heat transfer from above the LP argon stripper to a midlength location of the MP column, and also by providing a colder source of reflux to the LP column overhead, e.g., liquid $N_2$ (either direct injection or indirect heat exchange) when necessary to reject $N_2$ from the LP overhead. However these improvements still have the problem of yielding product oxygen at lower than normal pressures, e.g., at a vacuum. A further disclosed improvement, which further increases oxygen purity, entails withdrawing liquid oxygen from the LP column bottom and gasifying it by indirect latent heat exchange at the top of the argon stripping section—this causes an even further reduction in the oxygen production pressure.

It is known to incorporate compressor recycle of an argon stream, generally an impure argon stream, into cryogenic air separation plants for several different advantageous purposes. In U.S. Pat. Nos. 3,596,471 and 4,057,407, an argon compressor external to the cold box is used to compress argon derived from the argon rectifying section of the low pressure column, thereby increasing the reboil rate through that section. The objective of the former patent is to recover krypton and xenon, while that of the latter is to increase argon recovery and purity. In U.S. Pat. No. 3,222,878 and also in application U.S. Ser. No. 501,264 supra, an argon recycle compressor external to the cold box is described which is used to produce pressurized oxygen by latent heat exchange of the compressed argon with pumped liquid oxygen. The condensed argon is subsequently used to reflux the argon rectifying section of the low pressure column. (That section is frequently referred to as the "auxiliary column"). All of these configurations incorporate an argon recycle compressor which is external to the cold box, and hence entail substantial pressure drops of the argon when exiting and reentering the cold box, plus some temperature gain due to heat exchanger inefficiency. This, coupled with the fact that the argon compressor is compressing a warm gas rather than a cold one, results in greatly increased argon compression energy requirements. The circulating argon gas is preferably no more than about 30% oxygen to preclude need for special oxygen tolerant construction of the compressor. These configurations are reported to be useful for $O_2$ delivery pressures up to about 40 atmospheres, but are claimed to require more power than external compression of oxygen by $O_2$ compressors. (H. Springmann, Linde Reports on Science and Technology 31/1980, "The Production of High-Pressure Oxygen")

It is known to incorporate a split supply pressure in an air separation process to increase the delivery pressure of the product oxygen. Part of the supply air is compressed to a higher than normal pressure and then vaporized against boiling pumped liquid oxygen. U.S. Pat. Nos. 3,500,651, 3,754,406, and 4,279,631 illustrate versions of this. The Springmann article supra also describes this. An improvement to this technique, utilizing an additional higher pressure rectifier to vaporize the LOX rather than a simple reboiler/condenser, is disclosed in application Ser. No. 416,980 filed 9/13/83 by Donald C. Erickson, which is incorporated by reference.

It is known to incorporate thermocompressors in cryogenic air distillation processes whereby the pressure letdown of liquid nitrogen from the HP rectifier is the motive power for compressing some nitrogen gas to a pressure above the LP column pressure. U.S. Pat. Nos. 4,091,633 and 4,325,719 are two versions of this technique.

It is known that in distillation it is desirable to add heat (reboil) to the stripping (bottom) section of a distillation column over a range of tray heights or temperatures, and similarly for the rectifying (top) section to reject heat (i.e., add reflux) over a range of tray heights or temperatures. Several of the prior art disclosures referred to above incorporate two or more discrete exchanges of heat from the HP rectifier to the stripping section of a lower pressure column. However it is also known to conduct this heat exchange continuously over a range of tray heights. This is accomplished by "differential" or "non-adiabatic" distillation, as described in U.S. Pat. Nos. 3,508,412 and 3,563,047.

There is a need for a method of increasing the reboil rate through the argon stripping and rectifying sections of the low pressure distillation column in an air separation process without incurring the high energy penalties of an argon compressor recycle circuit with the compressor external to the cold box. This would yield several unexpected advantages, as detailed below.

DISCLOSURE OF INVENTION

A process and apparatus is provided incorporating a low pressure distillation column with both argon stripping and argon rectifying sections wherein an argon recycle compressor internal to the cold box compresses vapor from the argon rectifier and discharges it to a reboiler/condenser so as to reboil liquid oxygen bottom product from the bottom of the argon stripper, thereby increasing the reboil rate through both the argon stripper and the argon rectifier. The condensed argon is direct injected into the argon rectifier overhead as reflux.

The extra compression duty within the cold box adds to the refrigeration requirement. If there is already excess refrigeration available, no additional provision will be necessary—the argon compressor takes advantage of refrigeration which would otherwise be wasted, and as a result improves the recovery and purity of both the argon and oxygen. This could be done for example during cold weather with a plant that is designed for warm weather.

The argon recycle compressor only requires a compression ratio of approximately two due to its location in the cold box. Thus its power requirement and resulting refrigeration requirement are very small. When more argon recycle is desired than possible from waste refrigeration, additional refrigeration is required, either by increasing flow through an existing expander or by incorporating an additional expander. For every mole of nitrogen gas from the HP rectifier overhead that can be expanded, more than one mole of argon can be recycled, resulting in more reboil through the argon stripper than the condensing of the nitrogen would otherwise have caused. Alternatively supply air can be expanded. The recycle compressor can be directly driven by one of the expanders, thus decreasing cost. When two expanders are provided, they can operate at different temperatures so as to equalize the temperature differential across and hence maximize the effectiveness of the main heat exchangers which separate the cold box from the outside world.

As indicated above, the disclosed invention has general utility in many different air separation plants and circumstances. However one of the greatest advantages it provides is in low energy triple pressure flowsheets for producing medium to high purity oxygen. In those, it makes it possible to avoid the low oxygen delivery pressures that were previously characteristic. In particular, it makes possible the use of a high efficiency split supply pressure pumped LOX flowsheet, as disclosed in application No. 416,980 supra, in combination with a high efficiency triple pressure medium to high oxygen purity flowsheet as disclosed in application No. 501,264 supra. Thus it is possible to provide medium to high purity oxygen delivery pressures up to about 10 atmospheres at high efficiency and without either an oxygen compressor or an external argon recycle compressor.

BRIEF DESCRIPTION OF THE DRAWINGS

The five figures illustrate several of the many configurations which will benefit by incorporation of the disclosed recycling or heat pumping of an argon-rich stream within the cold box. The first four are various versions of the high efficiency triple pressure configuration incorporating LP to MP latent heat exchange.

In FIG. 1, nitrogen recycle from the LP column to the MP column is via a combination of liquid and thermocompressed vapor, and reflux is via latent heat exchange with boiling nitrogen. The argon recycle is merely to increase $O_2$ purity and argon recovery, as $O_2$ delivery pressure is not increased.

In FIG. 2 $N_2$ removal from the LP column $N_2$ rectifier is by a combination of recycle thermocompression, and vacuum compression, and reflux is via direct injection of liquid nitrogen. The argon recycle not only increases $O_2$ purity, but makes possible a pumped LOX configuration for pressurizing product oxygen from a split supply pressure.

BEST MODE FOR CARRYING OUT THE INVENTION

Figure 1:
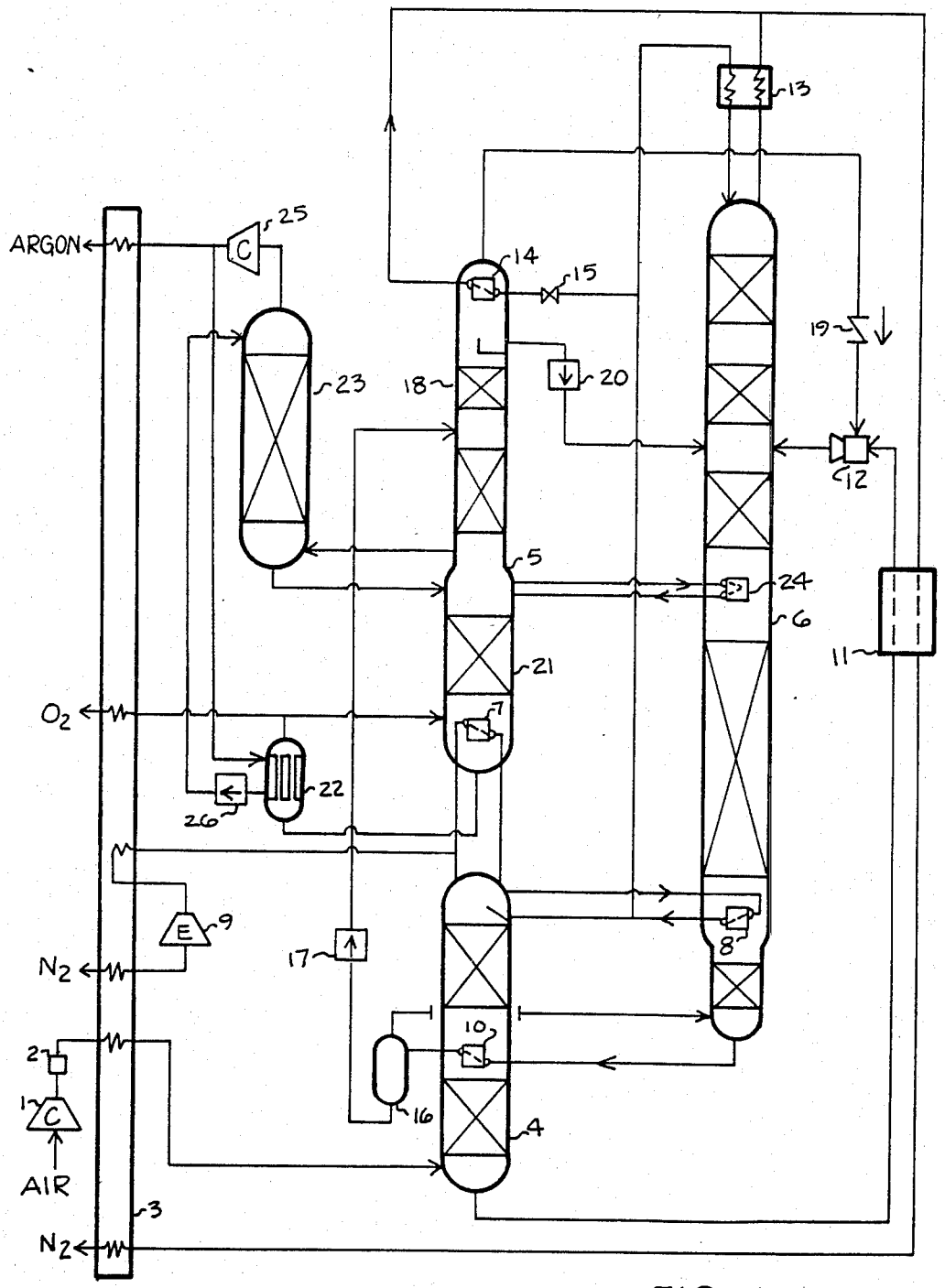
In FIGS. 1 and 2 the low pressure column has both an argon rectifier and a nitrogen rectifier.

Referring to FIG. 1, air is compressed in main air compressor 1, cleaned and dried in cleaner-drier 2, and cooled in main heat exchanger 3 which may be regenerative, reversing, or other known types. It enters the bottom of high pressure rectifier 4. Nitrogen gas from the rectifier overhead provides reboil to LP column 5 and MP column 6 via reboiler/reflux condensers 7 and 8 respectively, via transfer of latent heat. Another part of the nitrogen gas provides refrigeration by expansion in expander 9. A midlength location of the HP rectifier also transfers latent heat to the MP column via reboiler/reflux condenser 10. Bottom liquid (oxygen enriched liquid air) from the HP rectifier is supplied the MP column via sensible heat exchanger 11 and means for pressure reduction 12, in this instance a thermocompressor. Overhead liquid nitrogen is supplied as direct injection reflux to MP column 6 via sensible heat exchanger 13, and is supplied to reflux LP column 5 overhead by latent heat exchange in evaporator/reflux condenser 14 via control valve 15. Bottom liquid from MP column 6, which consists mainly of oxygen and argon and contains no more than about 10% nitrogen, is routed through separator 16 and means for one way flow control 17, e.g., a check valve or pump, and is introduced into LP column 5. The residual nitrogen content of that stream is rectified to overhead in the $N_2$ rectification section 18 of LP column 5. It is removed from the LP column and recycled to the MP column partly in vapor phase by thermocompressor 12 and one way valve 19, and partly in liquid phase by means for one way flow control 20, e.g., a check valve or pump. The liquid oxygen-argon mixture washing down the LP column is stripped of much of the argon in the argon stripper section 21 of LP column 5, by the action of ascending vapor from reboiler 7 and reboiler/condenser 22. After traversing argon stripper, the ascending vapor divides between the $N_2$ rectification section 18, the argon rectification section 23, and reboiler/reflux condenser 24, which transfers latent heat from an LP column midlength or intermediate location to an MP column midlength or intermediate location. The fraction of vapor entering and ascending argon rectifier 23 is washed by liquid reflux so as to remove much of the oxygen, leaving an argon stream of approximately 70% or higher purity overhead. That stream is compressed by compressor 25 to a pressure sufficient to condense against boiling oxygen in reboiler/condenser 22. The resulting liquid argon condensate is returned to the argon rectifier as direct injection reflux via means for one way flow control 26, e.g., a check valve or pump. Part of the argon may be withdrawn as product or for further purification. Gaseous oxygen bottom product from LP column 5 and gaseous nitrogen overhead from MP column 6 and heat exchanger 14 are withdrawn from the cold box via heat exchanger 3.

Using this flowsheet for the production of medium (>96%) to high (>98%) purity oxygen, the HP rectifier pressure will normally be about 4 ATA. The MP column overhead pressure will be about 1.5 ATA, i.e., just sufficient to spontaneously exhaust the gaseous $N_2$ to ambient. The LP column will operate approximately at or below atmospheric pressure, and hence cannot discharge products at design flow rates to atmospheric pressure without mechanical assist. There will normally be up to about 10% $N_2$ in the MP column liquid bottom product, and typically 1 to 5%.

Figure 2:
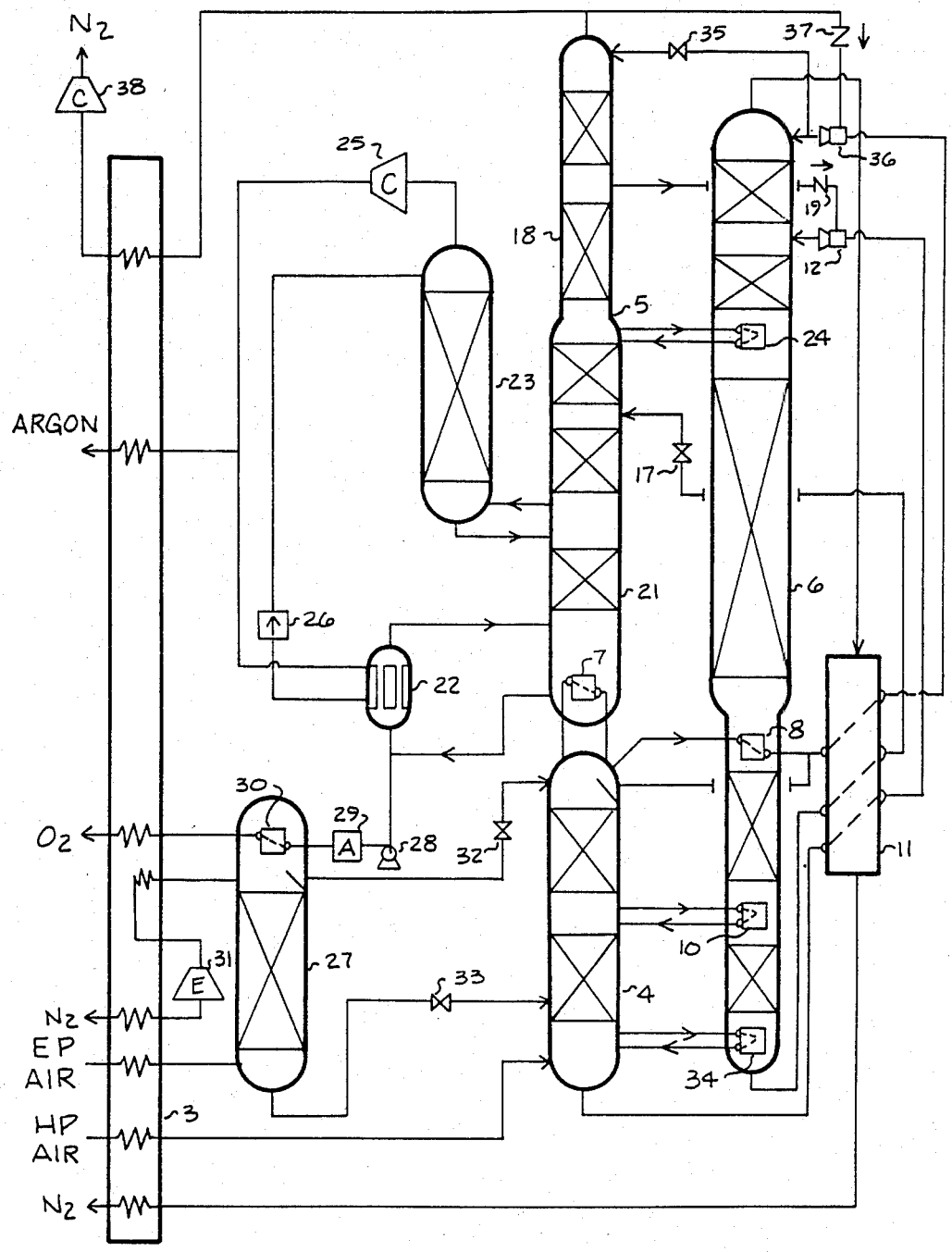

In FIG. 2, components 3 thru 8, 10 thru 12, 17 thru 19, and 21 thru 26, perform functions as described above, as modified below. The main difference between FIGS. 1 and 2 is that FIG. 2 incorporates an elevated pressure rectifier 27 and liquid oxygen pump 28, enabling pressurized high purity oxygen to be produced directly without requirement for an oxygen compressor. Liquid oxygen bottom product from LP column 5 (argon strip section 21) is pressurized in LOX pump 28, cleaned of trace contaminants in adsorber 29, and supplied to vaporizer/reflux condenser 30, where it is gasified at pressure. Part of the supply air is further compressed to an elevated pressure and supplied to the bottom of elevated pressure rectifier 27. The elevated pressure required is approximately three times the desired $O_2$ delivery pressure, depending on the temperature differential of exchanger 30. For example, an $O_2$ delivery pressure of 5 ATA and a 2K $\Delta T$ will require an elevated pressure of about 16 ATA at the compressor discharge. The amount of supply air compressed to elevated pressure will be between approximately 22 and 35% of the total air supplied, depending on the amount of $N_2$ supplied expander 31. Liquid $N_2$ and oxygen enriched liquid air from the elevated pressure rectifier are routed to the heat integrated triple pressure column 4, 5, and 6 via pressure letdown valves 32 and 33 respectively for further separation. The valves could alternatively be thermocompressors.

FIG. 2 illustrates several optional features. An additional reboil is supplied to the bottom of MP column 6 via reboiler/condenser 34, which transfers latent heat from supply HP air (or equivalently from the bottom of the HP rectifier) to the MP column bottom liquid. This allows lower HP rectifier pressures and hence lower energy consumption. The nitrogen rejection from the $N_2$ rectification section 18 of LP column 5 is all done in vapor phase, and refluxing of that section is done by direct injection of liquid nitrogen through J-T valve 35. Impure nitrogen containing vapor is thermocompressed by 12 as before, and higher purity nitrogen vapor is both thermo-compressed by liquid nitrogen via one way valve 37 and thermocompressor 36, and also is vacuum compressed out of the cold box by vacuum compressor 38.

Figure 3:
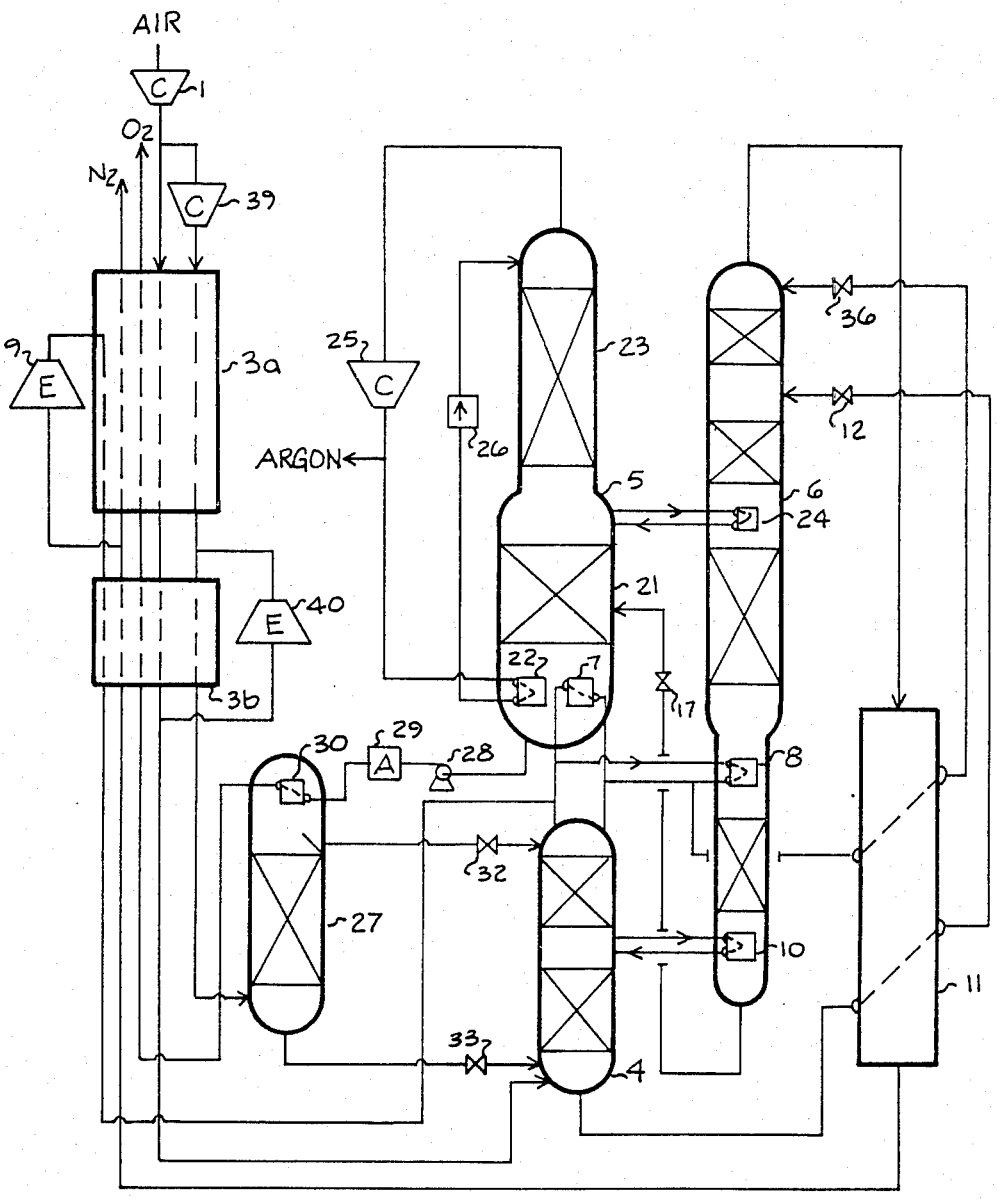
FIG. 3 also incorporates split supply pressure and LOX pumping for producing pressurized high purity oxygen. It differs from FIG. 2 in that no $N_2$ rectification section is present in the LP column, since the MP column bottom liquid contains less than about 1% $N_2$, and in incorporating a second refrigeration expander.

It will be apparent that a variety of refrigeration expander options are available. Gaseous $N_2$ from either the HP or EP rectifier overhead can be expanded. EP rectifier overhead can be expanded either to atmospheric pressure or to HP rectifier pressure. Part or all of either the HP air supply or the EP air supply can be expanded into any of the several distillation columns. FIG. 3 illustrates two of the above options.

In FIG. 3, the description of components 1, 3 thru 11, 17, 21 thru 30, 32, and 33 corresponds to the same numbered components described above for FIGS. 1 or 2. Part of the supply air from HP compressor 1 is further compressed in elevated pressure compressor 39 and cooled in the first section of main exchanger 3*a*. Then part of the elevated pressure supply air is expanded in expander 40 to HP supply pressure, and joins that stream entering HP rectifier 4. The remaining EP supply air enters EP rectifier 27. Processing and separation proceeds as described above, except in this case the bottom liquid from the MP column is reduced to below about 1% $N_2$ content, and hence a nitrogen rectification section is not necessary in the LP column. The LP column consists only of argon stripping section 21 and argon rectification section 23. Cold argon recycle compressor 25 and reboiler/condenser 22 provide reflux and reboil to both sections; whereas reboiler 7 provides reboil only to the stripper, and thence to the MP column via exchanger 24. An optional addition would be to provide more reflux to the argon rectification section in the conventional manner, by latent heat exchange with part of the oxygen enriched liquid bottom product from the HP column. The refrigeration duty is partly supplied expander 9 supplied with HP rectifier $N_2$, and partly by expander 40, with the two expanders developing refrigeration at different temperature levels to equalize the temperature differential across exchangers 3*a* and 3*b*. Since no thermocompression of $N_2$ vapors is required, pressure letdown devices 12 and 36 are merely J-T valves in this flowsheet.

Figure 4:
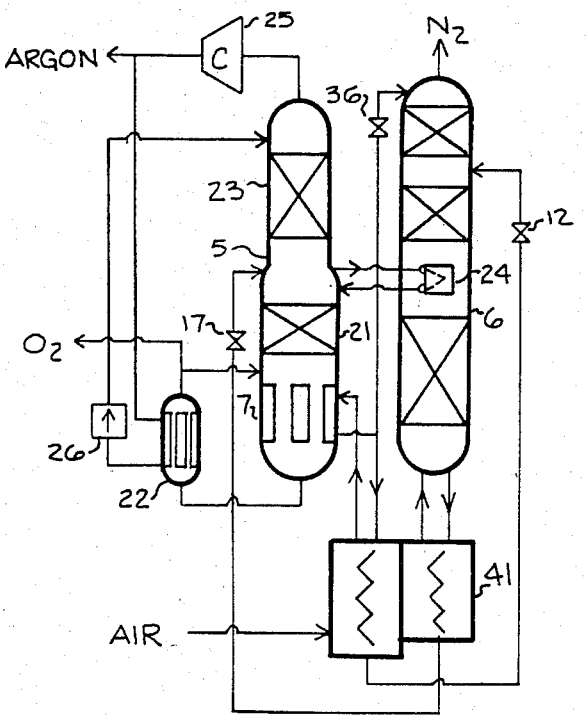
FIG. 4 illustrates one way non-adiabatic distillation can be incorporated in a triple pressure flowsheet incorporating cold argon recycle.
Figure 5:
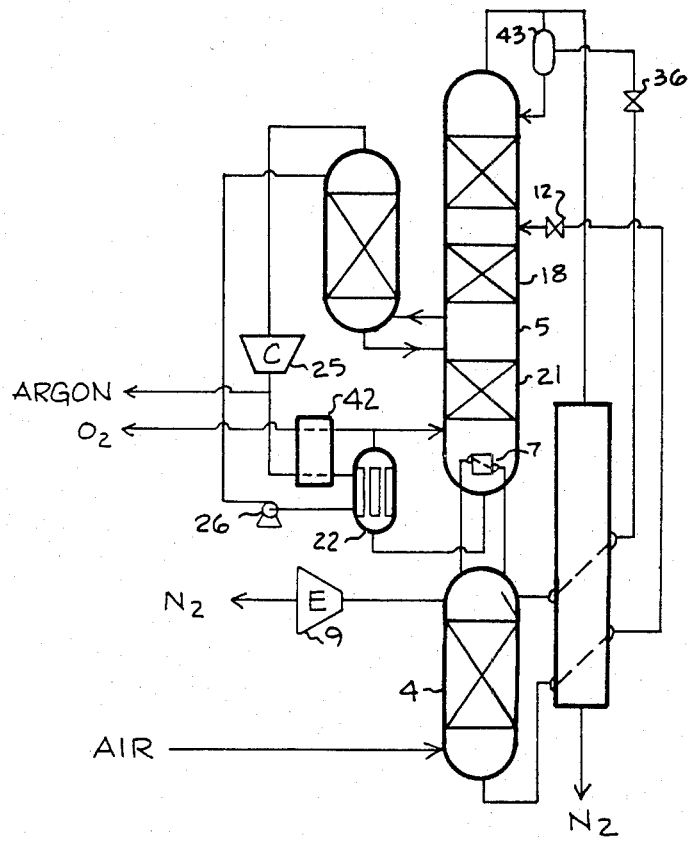
FIG. 5 illustrates the application of cold argon recycle to a conventional dual pressure column, as for example in a backfit installation.

FIG. 4 is a simplified version of FIG. 1 in which LP column 5 doesn't require a nitrogen rectification section, and in which the HP rectifier and bottom half of the MP column plus their associated discrete latent heat exchanges have been replaced by non-adiabatic fractionation device 41 with its associated continuous latent heat exchange. Only the main features are illustrated with many heat exchangers and other equipment or connections deleted for clarity. Similarly, FIG. 5 illustrates the application of cold argon recycle to a dual pressure column apparatus. The low pressure column 5 of the dual pressure apparatus contains an argon stripper section 21, argon rectification section 23, and nitrogen rectification section 18. Being a conventional configuration, the overhead nitrogen gas from the LP column exhausts spontaneously to atmosphere. Cold argon is recycled thru the stripper and argon rectifier as before, via recycle/heat pump compressor 25. Two optional features pertinent to all the flowsheets are illustrated—sensible heat exchange between compressed argon and gaseous oxygen in exchanger 42, and diversion of J-T valve expansion gas in separator 43. Clearly either of FIG. 4 or 5 could also incorporate the pumped LOX and elevated pressure rectification variations or embodiments.

It will be apparent to the artisan that many more variations or embodiments than those illustrated or described are possible within the scope of the disclosed invention, which is defined by the claims. The cold argon recycle can be applied to a single pressure column, dual pressure column, or triple pressure arrangement, indeed to any arrangement having both an argon stripper and rectifier. Argon vapor withdrawal from or liquid reflux to the argon rectifier is not required to be at the top, but either could be at an intermediate height also. Indirect heat exchange reflux may also be present in the argon rectifier. The pumped liquid oxygen can be vaporized against condensing compressed air rather than against condensing nitrogen from the EP rectifier. Both reboilers 7 and 22 function to vaporize liquid oxygen, at least part of which becomes reboil, whereas in some flowsheets some also becomes gaseous product. The happenstance that some or all of the gaseous oxygen from reboiler 22 may be withdrawn as product does not change its basic role of assisting reboiler 7 in supplying reboil to the LP column.

I claim:

1. In a process for separating air by cryogenic distillation comprising stripping argon from a liquid oxygen stream in an argon stripper and reducing the oxygen content of a gaseous argon stream in an argon rectifier, the improvement comprising increasing the reboil rate through the argon stripper and rectifier using a compressor internal to the cold box by:

(a) compressing gaseous argon from the argon rectifier;

(b) condensing at least part of the compressed argon by latent heat exchange with boiling oxygen from the argon stripper;

(c) reboiling the argon stripper with at least part of the evaporated oxygen from step (b);

(d) refluxing the argon rectifier with at least part of the condensed argon from step (b).

2. The process according to claim 1 wherein the argon stripper and rectifier are connected parts of the same low pressure column, wherein the refluxing is by direct injection, and comprising compressing the argon within the cold box without prior heat exchange, and comprising withdrawing part of the compressed argon.

3. The process according to claim 2 further comprising separating the air in a dual pressure distillation apparatus, wherein the argon rectifier and stripper are integral parts of the lower pressure column.

4. The process according to claim 3 further comprising additionally refluxing the argon rectifier by latent heat exchange with part of the oxygen enriched liquid air from the high pressure rectifier.

5. The process according to claim 2 further comprising separating the air in a triple pressure distillation apparatus incorporating latent heat exchange from above the argon stripper of the LP column to an intermediate height location of the MP column.

6. The process according to claim 5 further comprising removing a gas containing nitrogen from a separate nitrogen rectifying section of the LP column.

7. The process according to claim 2 further comprising supply part of the feed air at an elevated pressure, pumping liquid oxygen to a high pressure, and exchanging latent heat between the pumped liquid oxygen and at least part of the elevated pressure air.

8. The process according to claim 7 wherein the latent heat exchanging step comprises rectifying the elevated pressure air in an elevated pressure rectification column against boiling pumped liquid oxygen.

9. In a cryogenic air separation apparatus for producing medium to high purity oxygen comprising a low pressure distillation column comprising at least an argon stripper and an argon rectifier, the improvement comprising means designed, sized, and arranged for increasing the reboil rate through the stripper and rectifier while minimizing the energy requirements, including:

(a) an argon compressor which is internal to the cold box;

(b) a vapor conduit from the rectifier to the compressor;

(c) a means for vaporizing argon stripper bottom liquid by latent heat exchange with a condensing gas;

(d) a vapor conduit from the compressor to the heat exchange means;

(e) a liquid conduit to transport condensed argon from the heat exchange means to the argon rectifier reflux inlet.

10. The apparatus according to claim 9 further comprised of a means for ensuring unidirectional flow such as a pump or one-way valve disposed along the length of the liquid conduit.

11. The apparatus according to claim 9 further comprised of a liquid oxygen pump for pressurizing argon stripper bottom product oxygen liquid, and an oxygen vaporizer for vaporizing the pressurized oxygen by latent heat exchange with elevated pressure gas.

12. The apparatus according to claim 11 further comprising an elevated pressure rectifier which receives elevated pressure air at the bottom, supplies elevated pressure nitrogen gas to the oxygen vaporizer, is refluxed by part of the liquid nitrogen from oxygen vaporizer, and delivers the remaining liquid nitrogen plus oxygen enriched liquid bottom product to the remainder of the distillative air separation apparatus for further separation.

13. A triple pressure distillation apparatus for air separation comprising a high pressure (HP) rectifier which receives at least part of the supply air;

a medium pressure (MP) distillation column which received and further distills liquid bottom product from the HP rectifier, and which is refluxed by direct injection of liquid nitrogen;

a conduit for removing nitrogen vapor from the MP column overhead;

a low pressure (LP) distillation column which receives and further purifies liquid bottom product from the MP column;

at least one means for latent heat transfer from the HP rectifier to the MP column;

a means for latent heat transfer from the Hp rectifier to the LP column;

a means for latent heat transfer from the Lp column to the MP column;

means designed, sized, and arranged for increasing the reboil rate through the LP column while minimizing the energy requirement, including an argon compressor internal to the cold box.

14. The apparatus according to claim 13 further comprised of an argon stripping section and argon rectification section in the LP column; a compressor for compressing argon-rich vapor from the argon rectifier; and a latent heat exchanger for condensing argon-rich vapor against boiling argon stripper bottom product.

15. The apparatus according to claim 14 further comprised of a liquid oxygen pump for pressurizing argon stripper liquid bottom product and a liquid oxygen vaporizer for vaporizing the pressurized liquid oxygen.

16. The apparatus according to claim 15 further comprised of an elevated pressure rectifier which receives part of the supply air, and which supplies nitrogen vapor to the oxygen vaporizer where it is condensed.

17. The apparatus according to claim 13 further comprised of a nitrogen rectification section in the LP column; and a means for recycling nitrogen containing liquid from the nitrogen rectification section to the MP column.

18. The apparatus according to claim 13 further comprised of a nitrogen rectification section in the LP column; and a means for withdrawing nitrogen containing vapor from the nitrogen rectification section.

19. The apparatus according to claim 18 wherein at least part of the vapor withdrawn from the nitrogen rectification section is thermocompressed to the MP column by at least one thermocompressor powered by liquid from the HP rectifier.

20. The apparatus according to claim 13 wherein at least two of the distillation columns are associated in indirect heat exchange relation so as to permit at least latent heat transfer between the columns through adjacent walls thereof.

* * * * *